US006941086B2

(12) United States Patent
Kikuchi

(10) Patent No.: US 6,941,086 B2
(45) Date of Patent: Sep. 6, 2005

(54) IMAGE FORMING APPARATUS AND IMAGE FORMING SYSTEM FOR FORMING AN IMAGE ON TWO SIDES OF A RECORDING MEDIUM

(75) Inventor: Toshiyuki Kikuchi, Tokyo (JP)

(73) Assignee: Ricoh Company., Ltd., Tokyo (JP)

( * ) Notice: Subject to any disclaimer, the term of this patent is extended or adjusted under 35 U.S.C. 154(b) by 0 days.

(21) Appl. No.: 10/665,479

(22) Filed: Sep. 22, 2003

(65) Prior Publication Data

US 2004/0131397 A1 Jul. 8, 2004

(30) Foreign Application Priority Data

Sep. 19, 2002 (JP) ..... 2002-273811
Sep. 20, 2002 (JP) ..... 2002-274428

(51) Int. Cl.[7] ..... G03G 15/20; G03G 15/00

(52) U.S. Cl. ..... 399/68; 219/216; 399/8; 399/101; 399/306; 399/309; 399/329

(58) Field of Search ..... 399/67, 68, 8, 399/101, 306, 302, 308, 303, 329, 328, 322, 341, 309; 219/216, 243, 388; 347/156

(56) References Cited

U.S. PATENT DOCUMENTS

| | | | | |
|---|---|---|---|---|
| 4,172,976 A | | 10/1979 | Namiki et al. | 219/216 |
| 4,284,875 A | | 8/1981 | Namiki et al. | 219/216 |
| 5,024,430 A | | 6/1991 | Seki et al. | 270/58.14 |
| 5,027,159 A | | 6/1991 | Oda et al. | 399/309 |
| 5,053,827 A | * | 10/1991 | Tompkins et al. | 399/302 |
| 5,054,766 A | | 10/1991 | Seki et al. | 271/221 |
| 5,070,373 A | * | 12/1991 | Fukano et al. | 399/322 |
| 5,453,822 A | * | 9/1995 | Anzai et al. | 399/306 X |
| 5,614,999 A | * | 3/1997 | Kanesawa et al. | 399/329 |
| 5,991,563 A | * | 11/1999 | Haneda et al. | 399/68 |
| 6,097,921 A | | 8/2000 | Kageyama | 399/306 |
| 6,108,500 A | * | 8/2000 | Ohkama et al. | 399/67 |
| 6,272,309 B1 | * | 8/2001 | Kitazawa et al. | 399/328 X |
| 6,365,280 B1 | * | 4/2002 | Schlueter et al. | 399/308 X |
| 6,643,489 B2 | | 11/2003 | Omata et al. | 399/309 |
| 2002/0001476 A1 | * | 1/2002 | Nagamine et al. | 399/68 X |
| 2002/0061198 A1 | * | 5/2002 | Sameshima et al. | 399/68 |
| 2002/0090236 A1 | * | 7/2002 | Omata et al. | 399/309 |
| 2002/0122679 A1 | * | 9/2002 | Omata et al. | 399/309 |

FOREIGN PATENT DOCUMENTS

| | | | |
|---|---|---|---|
| EP | 1 022 622 2 | | 1/2000 |
| EP | 1 191 405 | | 3/2002 |
| JP | 1-209470 | | 8/1989 |
| JP | 10-039558 A | * | 2/1998 |
| JP | 10-142869 | | 5/1998 |
| JP | 10-228190 A | * | 8/1998 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A photoreceptor transfers a first image to a first side of a paper, an intermediate transfer belt transfers a second image to a second side of the paper. The intermediate transfer belt also conveys the paper. A conveying unit directly conveys the paper, with the images, to a heating unit that fixes the images. The paper is slowly conveyed in the heating unit as compared to when it is conveyed by the belt.

21 Claims, 5 Drawing Sheets

IMAGE FORMING APPARATUS AND IMAGE FORMING SYSTEM FOR FORMING AN IMAGE ON TWO SIDES OF A RECORDING MEDIUM

BACKGROUND OF THE INVENTION

1) Field of the Invention

The present invention relates to a technology for fixing images on both sides of a recording medium.

2) Description of the Related Art

When printing matter on both sides of a paper, commonly used approach is to form a toner image on one side of the paper, pass the paper through a fixing device to fix the toner image, reverse the paper, and form a toner image on the other side of the paper. This method has a problem in that sometimes the paper is not conveyed properly to the fixing unit. The causes of this problem are: the direction of the paper conveyance is reversed, and the heat applied to the paper, on which one image has already been fixed, curls the paper.

Japanese Patent Application Laid Open (JP-A) No. Hei 1-209470 discloses an image formation apparatus. In this apparatus, toner images are formed on both sides of the paper and the images on both sides of the paper are fixed in one process. In this apparatus, a first transfer unit transfers a first image formed on a photoreceptor to a transfer belt, the first transfer unit transfers a second image formed on the photoreceptor to one side of a transfer paper, and a second transfer unit transfers the first image on the transfer belt to the other side of the paper. Finally, the two images are fixed in one process.

Conventionally, as toner images are formed on both sides of the paper, a member for guiding the paper in the fixing unit can not be used. However, it is necessary to surely convey the paper to the fixing unit so as to prevent an unfixed image from being blurred due to its conveyance. JP-A No. Hei 10-142869 teaches to provide a spur to convey the paper with the toner images. This prevents the unfixed image from being blurred. However, there is a problem in that the toner gets stick to the spur, and this toner gets stick to the paper and degrades the image quality.

SUMMARY OF THE INVENTION

The present invention has been achieved to solve at least the problems in the conventional technology.

An image forming apparatus according to one aspect of the present invention includes a first image carrier that transfers an image to a first surface of a recording medium; a second image carrier that transfers an image to a second surface of the recording medium; and a conveying unit that directly conveys the recording medium, to which the image has been transferred by the second image carrier, from the second image carrier to a fixing unit, wherein a conveying speed of the recording medium at the fixing unit is equal to or lower than a conveying speed of the recording medium on the second image carrier.

An image forming apparatus according to another aspect of the present invention includes a first image carrier having a surface for carrying a toner image formed through an electrophotographic process; a second image carrier on which the toner image on the first image carrier is transferred, and that conveys a recording medium; a first transfer unit that transfers the toner image from the first image carrier to the second image carrier and to a first surface of the recording medium conveyed by the second image carrier; a second transfer unit that transfers the toner image from the second image carrier to a second surface of the recording medium conveyed by the second image carrier; a fixing unit disposed on downstream side of the second transfer unit with respect to direction of conveyance of the recording medium, the fixing unit including a fixing roller having a heat source; a pushing roller that pushes the fixing roller; and a support roller, wherein a belt is wound around between the support roller and the pushing roller, and the support roller rotates in the same direction as that of the pushing roller to rotate the belt, wherein the fixing unit fixes the toner image on the recording medium; and a guide unit that conveys the recording medium from the second image carrier toward the fixing unit, that brings the recording medium into contact with the belt wherein an angle is set to 60 degrees or less, the angle being formed between a direction of conveying the recording medium by the second image carrier and a moving direction of a portion of the belt in a zone from the support roller toward the pushing roller, and that guides the recording medium to a nip part between the fixing roller and the pushing roller.

An image forming system according to another aspect of the present invention includes an image forming apparatus including a first image carrier that transfers an image to a first surface of a recording medium; a second image carrier that transfers an image to a second surface of the recording medium; and a conveying unit that conveys the recording medium, to which the image has been transferred by the second image carrier, from the second image carrier to a fixing unit, wherein a conveying speed of the recording medium at the fixing unit is equal to or lower than a conveying speed of the recording medium on the second image carrier; an information processing unit connected to the image forming apparatus through a communication means; and an image formation controlling unit that performs controls over image formation including transmission of data for image formation from the information processing unit to the image forming apparatus.

The other objects, features and advantages of the present invention are specifically set forth in or will become apparent from the following detailed descriptions of the invention when read in conjunction with the accompanying drawings.

DETAILED DESCRIPTION

Exemplary embodiments of the present invention are explained below with reference to the accompanying drawings.

Figure 1:
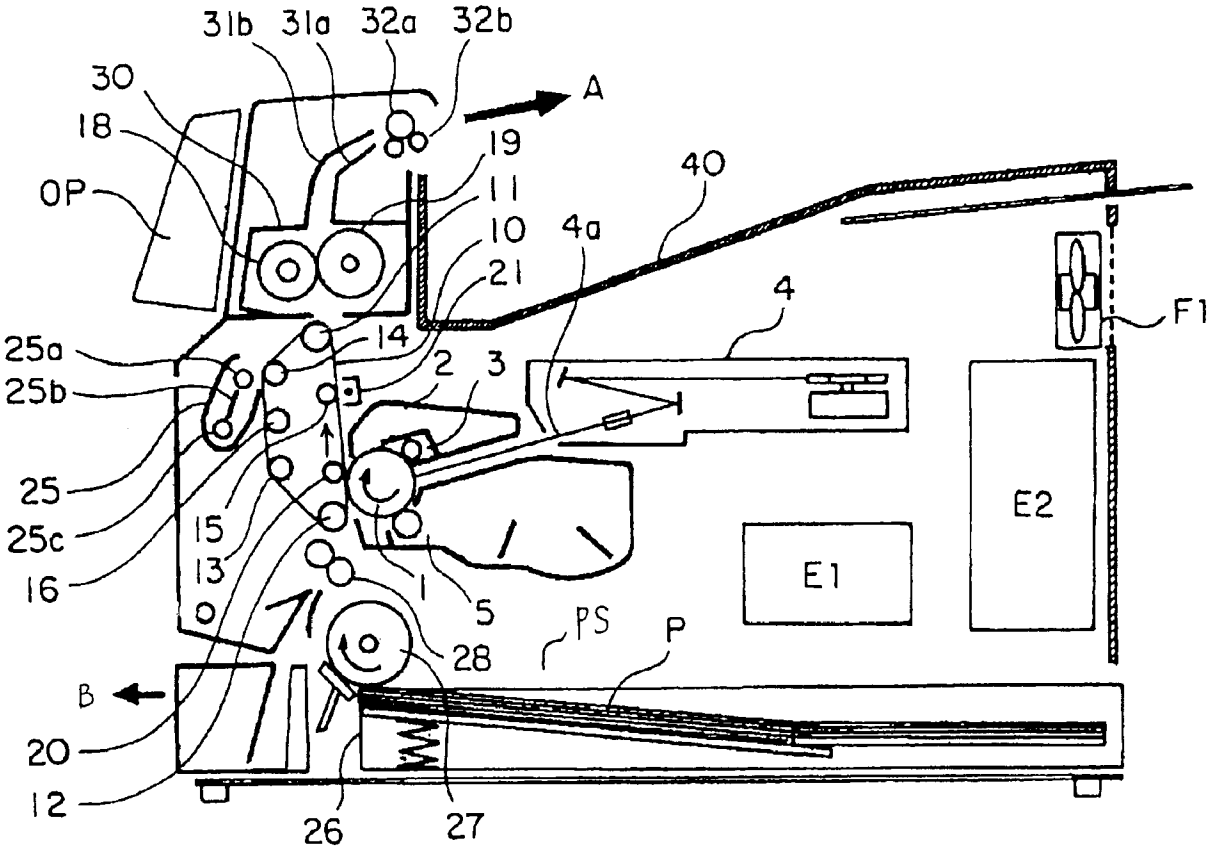
FIG. 1 is a side view of an image forming apparatus according to a first embodiment of the present invention.

FIG. 1 is a side view of an image forming apparatus according to a first embodiment of the present invention. A first drum-like image carrier (hereinafter, "photoreceptor") 1 rotates in a direction indicated by an arrow shown inside the photoreceptor 1. A cleaning device 2, a charger 3, and a developing device 5 are arranged around the photoreceptor 1. An exposing device 4 radiates a laser beam 4*a*. This laser beam 4*a* is guided to the photoreceptor 1 through a gap (hereinafter, "optical write region") between the charger 3 and the developing device 5.

A part of the photoreceptor 1 is in contact with a second image carrier (hereinafter, "intermediate transfer belt") 10. Rollers 11, 12, and 13 movably support and stretch the intermediate transfer belt 10 to form a loop. A first transfer device 20 is disposed near the photoreceptor 1 in such a manner that the intermediate transfer belt 10 is sandwiched between the first transfer device 20 and the photoreceptor 1. Moreover, backing rollers 14 and 15 and a cooling device 16 are arranged inside the loop of the intermediate transfer belt 10. The intermediate transfer belt 10 is made of a heat-resistant material such as a polyimide, moreover, it is electrically conductive so that toner gets stick to it. A second transfer device 21 and a cleaning device 25 for cleaning the intermediate transfer belt 10 are provided near the intermediate transfer belt 10.

A heating device (sometimes called as "fixing device") 30 is disposed near the intermediate transfer belt 10. This heating device 30 includes a roller with a built-in heater. The heating device 30 heats the paper that carries the images to fix the toner images to the paper. As the heating device 30 is located close to the intermediate transfer belt 10, the paper with the unfixed toner images can be conveyed directly to the heating device 30 and the images do not get blurred. In other words, a conveying unit such as the spur is not required. As the intermediate transfer belt 10 is made of heat-resistant material, it does not deform although it is disposed near the heating device 30.

The speed (hereinafter, "first speed") at which the paper is conveyed through the heating device 30 is equal to or lower that the speed (hereinafter, "second speed") at which the intermediate transfer belt 10 conveys the paper. Preferably, the first speed is 90 to 100% of the second speed.

Experiments were conducted using A-4 size papers with the space s (see FIG. 2) between the outer periphery of a fixing roller 18 in the heating device 30 and the outer periphery of the transfer roller of the intermediate transfer belt 10 set to 60 millimeters. The paper on the intermediate transfer belt 10 was properly conveyed to the heating device 30. It was thus confirmed that it is preferable that the space s be 60 millimeters or less. Further, keeping in mind that even papers smaller than A-4 size may be used in this image formation apparatus, it is preferable that the space s be 30 millimeters. Moreover, it is preferable that the paper conveying speed of the fixing roller 18 is about 5% slower than the paper conveying speed of the intermediate transfer belt 10. Excellent image were obtained in experiments when such configuration was employed.

Figure 2:
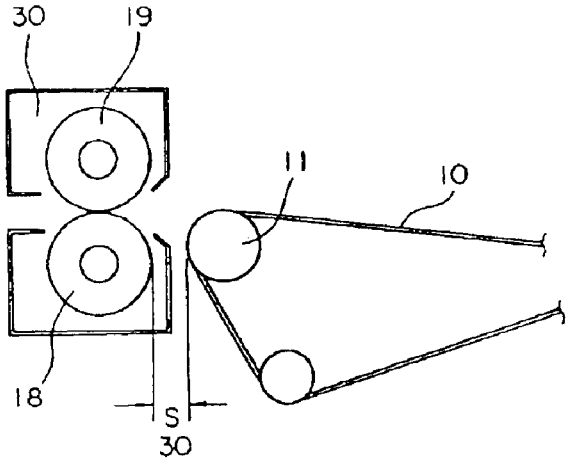
FIG. 2 is a side view (not to scale) of a portion around a fixing device and an intermediate transfer belt according to the first embodiment.

Referring to FIG. 2, the diameter of the fixing rollers 18 and 19 in the fixing device 30 is 30 millimeters, and the diameter of the roller 11 is 20 millimeters. As the roller 11 is small, the paper P (not shown), which is electrostatically adhered to the intermediate transfer belt 10, cannot follow the curvature of the roller 11. As a result, the front edge of the paper P gets separated from the intermediate transfer belt 10 and enters between the fixing rollers 18 and 19. Therefore, it is preferable that the roller 11, in other words, the intermediate transfer belt 10, is close to the fixing rollers 18 and 19 as far as possible. However, the fixing rollers 18 and 19 are hot and the heat may deform the intermediate transfer belt 10 if the two are too close. Therefore, an appropriate space s of 30 millimeters is required between the two.

It may appear in FIG. 2 that the paper is conveyed in the horizontal direction, but, as shown in FIG. 1, in reality the paper is conveyed vertically. This has advantage in that, the gravity does not act on the paper, moreover, heat from the fixing rollers 18 and 19 conducts above rather towards the intermediate transfer belt 10.

As the intermediate transfer belt 10 is close to the heating device 30, toner remaining (hereinafter, "residual toner") on the intermediate transfer belt 10 melts. The cleaning device 25 cleans the molten toner. This cleaning device 25 includes a roller 25*a*, a blade 25*b*, and a toner conveying unit 25*c*. The roller 25*a* can come in contact with or separate from the intermediate transfer belt 10. The surface roughness of the roller 25*a* is greater than that of the transfer belt 10. Generally, the surface roughness of the intermediate transfer belt 10 is 3.5 micrometers or less. For example, it the surface roughness of the intermediate transfer belt 10 is 3.4 micrometers, then the surface roughness of the roller 25*a* is preferably 5 micrometers. The roller 25*a* is, for example, metallic.

The photoreceptor 1, the cleaning device 2, the charger 3, and the developing device 5 may be integrated into one unit, i.e., a process cartridge, so that an old process cartridge can be replaced with a new one when required.

A first paper feed device PS is provided in a casing in a lower part of the main body of the apparatus. The first paper feed device PS includes a paper feed cassette 26 and a paper feed roller 27. The paper feed cassette 26 is disposed perpendicular to the surface of the paper so that the cassette 26 can be pulled frontward indicated by the arrow B. Further, rotation of the paper feed roller 27 allows the recording medium as paper P stored in the paper feed cassette 26 to be sent sheet by sheet from the uppermost sheet of paper, and the paper P reaches the registration rollers 28.

The paper P on which the images have been recorded is placed on a discharged paper stack part 40 through guides 31*a* and 31*b* and rollers 32*a* and 32*b* that are disposed on the downstream side of the heating device 30 in the paper conveying direction.

Electrical components controllers E1 and E2 are installed in the apparatus. A fan F1 runs to prevent excessive increase in temperature in the apparatus.

In the image forming apparatus, the photoreceptor 1 is an electrophotographic photoreceptor, and the intermediate transfer belt 10 is preferably a belt made of a material having a surface resistivity of from $10^5$ to $10^{12}$ Ω/sq. The intermediate transfer belt 10 forms a toner releasing layer thereon, and a Teflon (trade mark) layer can be used for this toner releasing layer.

The image forming apparatus structured as explained above operates as follows. If images are to be formed on both sides of the paper, the light emitted from a laser light source (not shown) of the exposing device 4 reaches over the photoreceptor 1 that is uniformly charged by the charger 3 to form a latent image corresponding to write information. The developing device 5 develops the latent image on the photoreceptor 1 to form and hold a toner image on the surface of the photoreceptor 1. The first transfer device 20 disposed on the rear side of the intermediate transfer belt 10 transfers the toner image to the surface of the transfer belt 10 that is moving in synchronization with the photoreceptor 1.

The cleaning device 2 cleans toner remaining on the surface of the photoreceptor 1, and the photoreceptor 1 is in a standby state for the following image forming cycle. The toner image transferred to the intermediate transfer belt 10 moves together with the transfer belt 10 in the direction of the arrow. During the movement, in order to prevent the toner image from being blurred, the second transfer device 21 and the cleaning device 25 are controlled so as to be kept in a non-operation state, that is, power shutdown or separation of the devices from the belt 10.

When the transfer belt 10 moves up to a predetermined position, a toner image supposed to be formed on another surface of the paper P is started to be formed on the photoreceptor 1 in the process as explained above, and the paper starts to be fed from the paper feed device. The uppermost sheet of paper P in the paper feed cassette 26 is pulled out by rotation of the paper feed roller 27 in the direction of the arrow and is conveyed to a nip part of the registration roller pair 28. The paper P is then sent to a nip between the transfer belt 10 and the photoreceptor 1 through the registration roller pair 28, and the toner on the surface of the photoreceptor 1 is first transferred to the paper P by the first transfer device 20. For this transfer, timing is controlled by stopping or rotating the registration roller pair 28 so that the paper P and the position of the image are registered.

During transfer of the toner from the photoreceptor 1 to the paper P, the other side of the paper P moves together with the toner on the transfer belt 10. When the paper P passes through the region of the second transfer device 21, a voltage is applied to the second transfer device 21 to transfer the toner on the transfer belt 10 to the paper P.

The toner images are transferred to both sides of the paper P by the action of the first transfer device 20 and the second transfer device 21, and the paper P departs from the transfer belt 10 to be sent to a region where the fixing device 30 is provided. The toner images on both sides of the paper P are fixed at a time by the fixing rollers 18 and 19, and then the paper is conveyed to the discharging part. In this embodiment, the paper-P conveying speed of the fixing rollers 18 and 19 is set to a value lower by 5% than the paper-P conveying speed of the transfer belt 10. As a result, the paper is conveyed at an appropriate speed.

Exposure is performed so that an image transferred from the transfer belt 10 to the paper P is formed as a normal image and a toner image directly transferred from the photoreceptor 1 to the paper P is formed as a reverse image. The order of forming images for page alignment is realized by a known technology for storing image data once in memory, reading the data in image formation, and transferring the data to a write side. Further, the exposure by switching between a normal image and a reverse image is also realized by a known image processing technology.

The cleaning device 25 is first positioned apart from the intermediate transfer belt 10, and then the device 25 is brought into contact with the belt 10 after the image is transferred from the belt 10 to the paper P. The device 25 then transfers residual toner, after the toner is transferred to the paper P, to the surface of the cleaning roller 25*a*, and the toner on the surface of the cleaning roller 25*a* is scraped off by the blade 25*b*. The scraped toner is collected by the toner conveying unit 25*c* to a container (not shown).

The intermediate transfer belt 10 having passed through the cleaning region is cooled by the cooling device 16. A cooling unit of various types of radiating system can be employed for the cooling device 16. For example, there is a cooling unit of an air circulation system. In this unit, it is preferable to circulate air over the transfer belt 10 after a toner image is transferred to the paper P so as to prevent a toner image carried on the transfer belt 10 from being blurred. Another type of cooling unit using a heat pipe can also be employed. This cooling unit is provided to take heat by direct contact of the heat pipe with the internal face of the loop of the transfer belt 10.

The image forming apparatus according to the first embodiment operates as follows when an image is formed only on one side of the paper.

When the recording medium is discharged to the discharged paper stack part 40, a step of transferring the toner to the transfer belt 10 can be omitted, and the toner image formed on the surface of the photoreceptor 1 is directly transferred to the paper P. As shown in FIG. 1, the paper P is sent to a nip between the photoreceptor 1 and the transfer belt 10 by controlling a timing so as to be registered with the toner image formed on the photoreceptor 1. The first transfer device 20 transfers the toner from the photoreceptor 1 to the paper P. The paper P moves together with the transfer belt 10 during which the second transfer device 21 does not operate, and then the paper P departs from the transfer belt 10 to be sent to the fixing device 30, where the toner is fixed. In this case, also, the paper-P conveying speed of the fixing rollers 18 and 19 is set to a value lower by 5% than the paper-P conveying speed of the transfer belt 10. As a result, the paper is conveyed at an appropriate speed.

The paper P is then discharged in the direction of the arrow A through the guides 31*a* and 31*b* and the paper discharge roller pair 32*a* and 32*b*, and is placed on the discharged paper stack part 40 in a state of image face-down.

Figure 3:
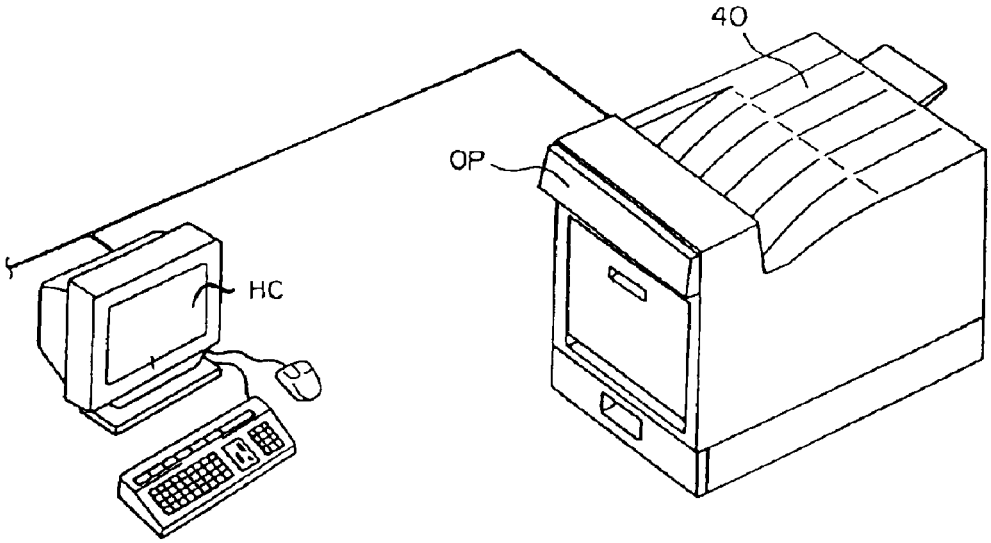
FIG. 3 is perspective view of an image forming system according to the first embodiment.

FIG. 3 is perspective view of an image forming system according to the first embodiment. This image forming system includes, for example, a printer and a host computer. The printer 40 has an operation panel OP at the upper front side. The operation panel OP is used for setting mode and operation of the printer 40. The host computer HC sends image data and control information to the printer 40. The printer 40 prints the images.

As explained above, according to the first embodiment, the paper is conveyed properly although a dedicated paper conveying unit is not provided. Moreover, the unfixed image does not blur.

Figure 4:
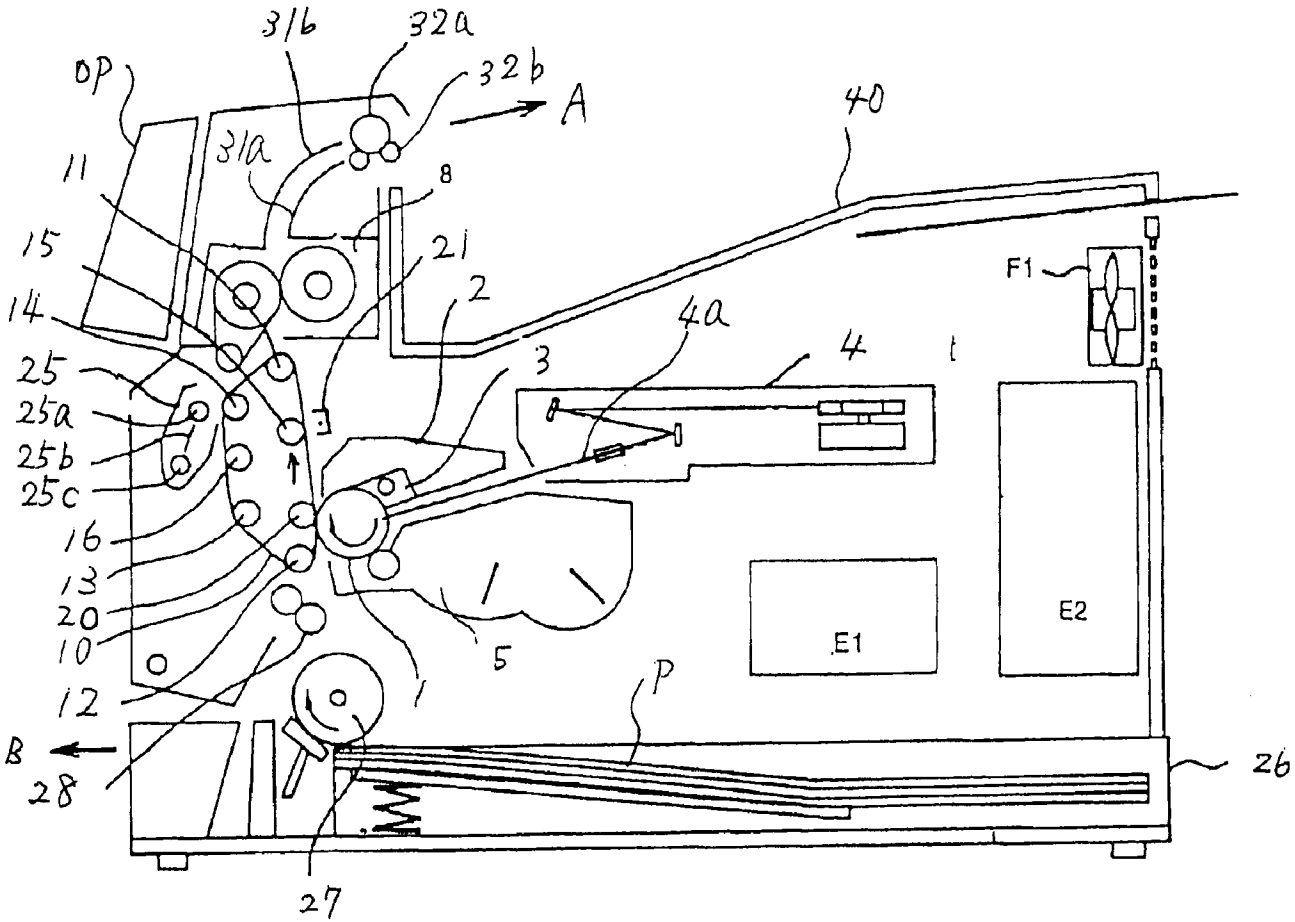
FIG. 4 is a side view of an image forming apparatus according to a second embodiment of the present invention.

FIG. 4 is a side view of an image forming apparatus according to a second embodiment of the present invention. This image forming apparatus includes a fixing device 8 instead of the heating device 30, and the rest of the structure is same as that of the image forming apparatus shown in FIG. 1. Toner images are transferred on both sides of a paper by the actions of the first transfer device 20 and the second transfer device 21. The paper then departs from the transfer belt 10 to be sent to the fixing device 8.

Figure 5:
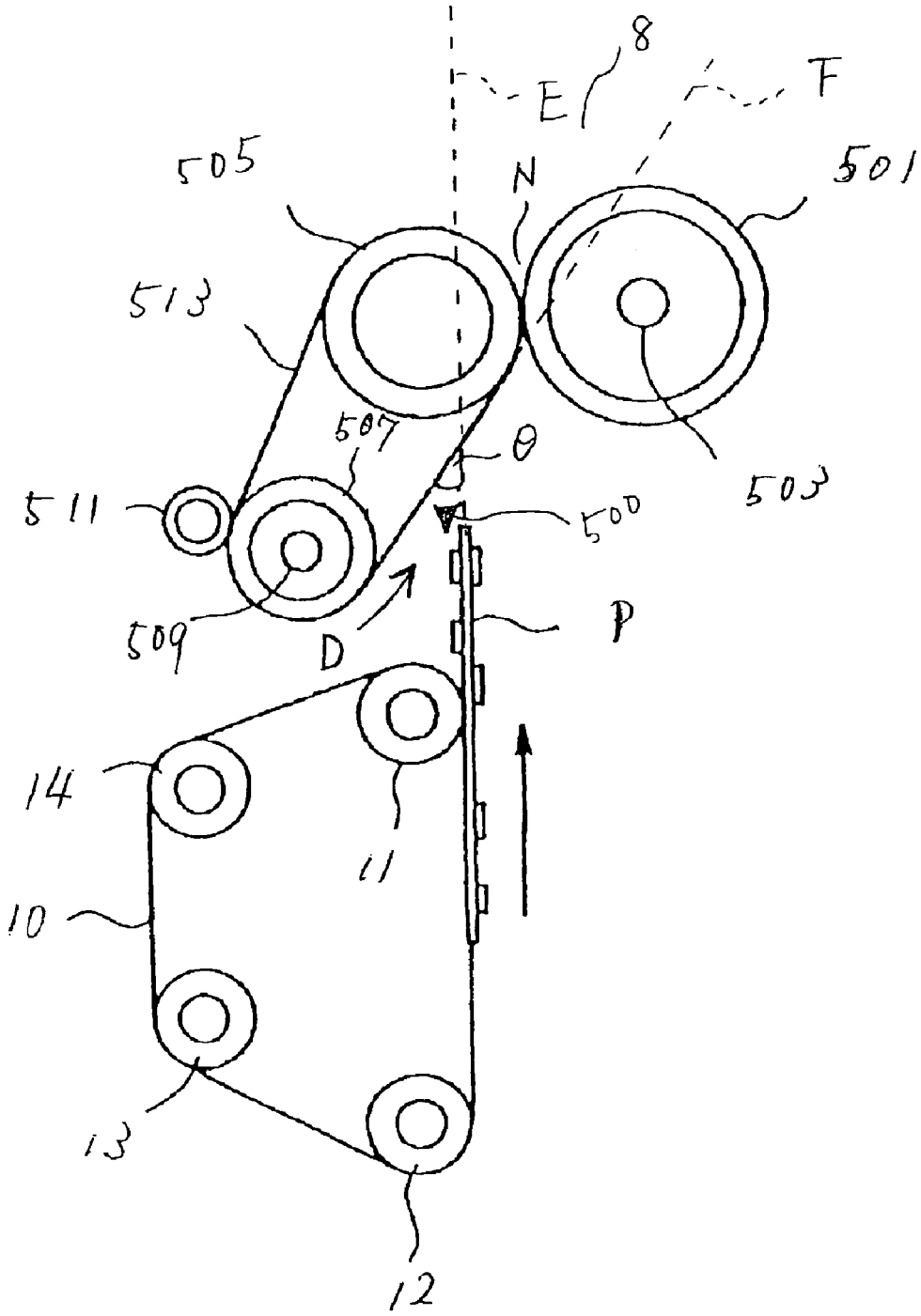
FIG. 5 is a side view (not to scale) of a portion around a fixing device and a conveying unit according to the second embodiment.

FIG. 5 is a side view (not to scale) of a portion around the fixing device 8 and a conveying unit that conveys the paper P to the fixing unit 8. The fixing device 8 is provided on the downstream side of the transfer device 21 in the paper conveying direction. The fixing device 8 includes a fixing roller 501, a pushing roller 505 that pushes the fixing roller 501, and a support roller 507. A belt (pressurizing belt) 513 is wound around between the support roller 507 and the pushing roller 505, and the support roller 507 rotates in the direction the same as that of the pushing roller 505 to rotate the pressurizing belt 513. The fixing roller 501 is internally provided with a heater 503. Further, the support roller 507 is a heating roller that is internally provided with a heater 509. The fixing device 8 of the second embodiment further includes a bias applying roller 511 that charges the pressurizing belt 513. The fixing device 8 structured as explained above functions as a fixing unit that fixes toner images transferred to the paper thereon.

The intermediate transfer belt 10 and the rotating rollers 11, 12, and 13 form a guide unit. This guide unit conveys the paper P from the transfer belt 10 to the fixing device 8. During the conveyance, the guide unit brings the paper P into contact with the pressurizing belt 513 at an angle θ that is set to 60 degrees or less. The angle θ is formed between a direction E of conveying the paper P by the transfer belt 10 and a moving direction F of a position 500 of the pressurizing belt 513 in a zone from the support roller 507 toward the pushing roller 505. The guide unit further guides the paper P to a nip N between the fixing roller 501 and the pushing roller 505.

Further, in the fixing device 8 of the second embodiment, the bias applying roller 511 as a charger applies a bias to the surface of the pressurizing belt 513 and therefore the surface is charged so as to have a reverse polarity to a charged polarity of the toner on the paper. By controlling the heaters 503 and 509, the fixing roller 501 and the heating roller 507 are kept in a fixable temperature range.

The paper with unfixed image thereon conveyed by the transfer belt 10 comes in contact with the pressurizing belt 513 rotating in the direction of the arrow D. At this time, the paper P is absorbed to the pressurizing belt 513 by the electrostatic force acting between the pressurizing belt 513 and the paper P. The paper P in this state is conveyed along the pressurizing belt 513 at substantially the same speed, and is heated and pressed at the nip between the fixing roller 501 and the pushing roller 505 to be fixed.

A linear velocity of the intermediate transfer belt 10 and a linear velocity of the pressurizing belt 513 may be controlled so as to allow the velocities to vary depending on types of paper (stiffness, surface nature, etc.) or types of image. It is ideal that the linear velocity of the transfer belt 10 and that of the pressurizing belt 513 are equal. In actual cases, however, it is difficult to make equal the conveying speed of the paper P by the belt 10 and that of the paper P by the belt 513 for such reasons as insufficient fabrication tolerance of components and conveying precision of a rotation transmitting system. To solve the problem, the paper conveying speed by the belt 10 is set to a value slightly higher (5% at maximum) than the speed by the belt 513.

That is, if the conveying speed of the pressurizing belt 513 is faster, the paper P is forcefully pulled by the fixing roller 501, which may cause a blurred image. However, if the conveying speed of the paper P is faster, slack is produced between the fixing roller 501 and the transfer belt 10, but the paper P is pulled at this time by the pressurizing belt 513 to accommodate the slack. Therefore, when the rear end of the paper P passes through the nip between the photoreceptor 1 and the transfer belt 10, the paper P is prevented from slippage on the transfer belt 10 in the reverse direction with respect to the paper conveying direction. Consequently, the paper P moves together with the pressurizing belt 513, thus obtaining stable fixing operation.

An appropriate material is selected for the surface of the fixing roller 501 and the pressurizing belt 513. Even if the surface of the pressurizing belt 513 is charged by contacting the fixing roller 501 with the pressurizing belt 513 to allow the paper P to be absorbed to the pressurizing belt 513, a high-quality image and excellent paper conveying capability can be obtained. Further, even if the paper P is decharged and the pressurizing belt 513 is charged, the paper P can be absorbed to the pressurizing belt 513. Therefore, any means may be used if the electrostatic force allows the paper P to be absorbed to the pressurizing belt 513.

When an image is to be recorded on one side (only top surface) of the paper P, a step of transferring toner to the intermediate transfer belt 10 is omitted from the process of recording images on both sides of the paper P, and a toner image formed on the surface of the photoreceptor 1 is directly transferred to the paper. As shown in FIG. 4, the paper P is sent to a nip between the photoreceptor 1 and the transfer belt 10 by controlling a timing for registration of the toner image on the photoreceptor 1 with the paper P, and the toner image is transferred from the photoreceptor 1 to the paper P by the first transfer device 20. At this time, the second transfer device 21 does not operate, and therefore, the paper P is moved together with the transfer belt 10, and then the paper P departs from the transfer belt 10, and the fixing device 8 fixes the toner on the paper P. At this time, the fixing device 8 stops heating by the heater 509. Further, if the bias applying roller 515 applies a bias to the paper P, the conveyance capability of the paper P is further improved, but the application may be stopped for power saving. The paper P is discharged in the direction of the arrow A through the guides 31*a* and 31*b* and the paper discharging roller pair 32*a* and 32*b* to be placed on the discharged paper stack part 40 in a state of image face-down.

If an image is recorded only on the rear face of the paper P and the paper P is stacked on the discharged paper stack part 40 in a state of image face-up, a step of forming a toner image directly transferred to the transfer belt 10 from the photoreceptor 1 after forming the toner image, to be transferred to the transfer belt 10, on the photoreceptor 1 is omitted from the process of recording images on both sides of the paper P. Steps other than the step are the same as those in the process of recording images on both sides of the paper P.

In the second embodiment, the intermediate transfer belt 10 is disposed close to the fixing device 8, moreover, the pressurizing belt 513 is arranged so that the paper conveying direction by the transfer belt 10 has an angle of 60 degrees or less with respect to the pressurizing belt 513. Therefore, the paper in contact with the pressurizing belt 513 can be satisfactorily conveyed toward a fixing nip, together with the pressurizing belt 513. Further, the surface of the pressurizing belt 513 is charged and the paper P is absorbed to the surface of the belt 513. Thereby, the paper P with toner images on both sides thereof can be fixed without occurrence of blurred images, and the high-quality images and the excellent conveying capability can be achieved. Furthermore, the paper-P conveying speed by the pressurizing belt 513 is set to equal to that by the transfer belt 10, or the paper-P conveying speed by the transfer belt 10 is set to slightly faster. It is, thereby, possible to prevent relative movement of the pressurizing belt 513 and the paper P during the paper conveyance, to fix images on the paper P without occurrence of blurred images, and to achieve the high-quality images and the excellent conveying capability.

The structure of the second embodiment may be applicable to color image forming apparatuses.

Figure 6:
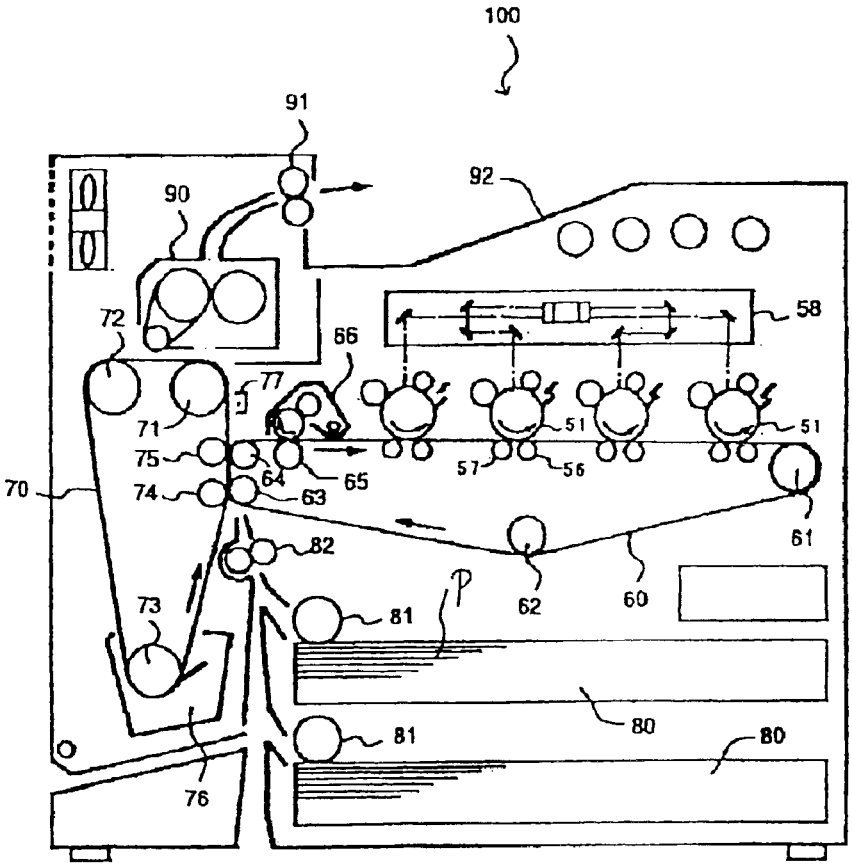
FIG. 6 is a side view of a color image forming apparatus according to a third embodiment of the present invention.
Figure 7:
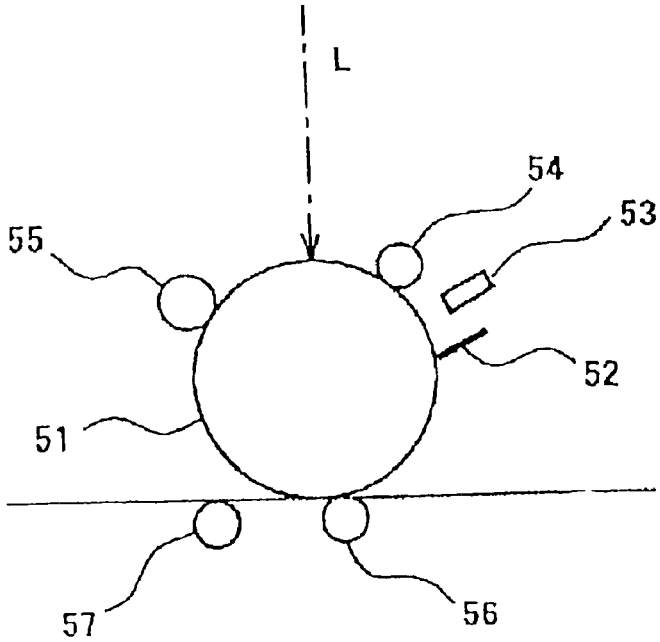
FIG. 7 is a side view (not to scale) of a portion around a photoreceptive drum according to the third embodiment.

FIG. 6 is a side view of a color image forming apparatus according to a third embodiment of the present invention. This color image forming apparatus is a so-called tandem type color printer 100. In other words, in this printer 100, four photoreceptive drums 51 are arranged in tandem with each other in a substantially central part of the apparatus. FIG. 7 is a side view (not to scale) of a portion around the photoreceptive drum 51. A cleaning device 52, a decharger 53, a charger 54, and a developing device 55 are arranged around the drum 51, and these devices form an image forming unit. The structure of all the image forming units is the same with the difference that they contain toners of different colors. A first intermediate transfer belt 60 is disposed under the four image forming units, and therefore, the four image forming units are arranged in contact with and along the upper side of the transfer belt 60. An exposing device 58 is also disposed above the image forming units.

The developing devices 55 in the image forming units store toners of cyan, magenta, yellow, and black, respectively, and develop electrostatic latent images formed on the photoreceptive drums 51 with the color toners. A write position is provided between the charger 54 and the developing device 55, and a laser beam L emitted from the exposing device 58 is radiated to the photoreceptive drum 51. The exposing device 58 employs a known laser system, and in the third embodiment, color separation is performed on an image and light information corresponding to color toner for development is radiated, as a latent image, to the surface of the drum 51 that has been uniformly charged. An exposing device formed with a light emitting diode (LED) array and an image forming unit can also be employed. Further, a transfer roller 56 is disposed on an opposite side to the drum 51 through the first intermediate transfer belt 60. Reference numeral 57 denotes a backing roller. The toner image formed on the drum 51 is transferred (primary transfer) to the first intermediate transfer belt 60 by the action of the transfer roller 56.

For formation of a full color image, color toners of cyan, magenta, yellow, and black formed on the photoreceptive drums 51 in the four image forming units are sequentially and superposedly transferred to the first intermediate transfer belt 60 to form a full color image on the belt 60. If a monochrome image to be formed, a toner image is formed only in the image forming unit for the black toner and a monochrome image is transferred to the first intermediate transfer belt 60.

The first intermediate transfer belt 60 is stretched and supported by four rotating rollers 61, 62, 63, and 64, and is rotatable in the clockwise direction as indicated by the arrow in FIG. 6. A backing roller 65 is disposed to the right of the rotating roller 64 inside a loop of the transfer belt 60. A belt cleaning device 66 is disposed on the outside of the belt loop so as to face the backing roller 65.

Paper feed devices (paper feed cassettes) in two stages 80 and 80 are installed in the lower position of the printer body. The uppermost sheet of paper stored in each of the cassettes is fed sheet by sheet by a paper feed roller 81 and sent to a registration roller pair 82.

A second intermediate transfer belt 70 is provided to the left of the first intermediate transfer belt 60. The second intermediate transfer belt 70 is stretched and supported by rotating rollers 71, 72, and 73, and transfer rollers 74 and 75 so as to be rotatable in the counterclockwise direction in FIG. 6 as indicated by the arrow. The transfer roller 74 is disposed at a position facing the rotating roller 63 for the transfer belt 60. A transfer charger 77 is disposed at a position between the rotating roller 71 and the transfer roller 75 so as to face the surface of the second intermediate transfer belt 70.

The first intermediate transfer belt 60 and the second intermediate transfer belt 70 are in contact with each other as positions of the rotating rollers 63 and 64 and the transfer rollers 74 and 75 to form predetermined transfer nips. The transfer belt 70 is swingably structured based on an axial center of the rotating roller 71 as a center of rotation so as to release the contact between the transfer belt 60 and the transfer belt 70 at the nip parts. A mechanism including a spring and a solenoid (not shown) performs operations of contact and separation between the transfer belt 60 and the transfer belt 70.

A belt cleaning device 76 is disposed below the transfer belt 70 and outside of the loop of the transfer belt 70. The cleaning device 76 is includes a cleaning blade to scrape off unnecessary toner or paper dust remaining on the surface of the transfer belt 70.

A fixing device 90 is disposed on the upper side of the transfer belt 70. The fixing device has basically the same structure as that of the fixing device 8, that is, the device includes a fixing roller, a pushing roller, a heating roller, and a pressurizing belt. Paper after an image is fixed thereon is discharged by discharge rollers 91 to a discharged paper tray 92 to be stacked thereon.

In the image forming apparatus according to the third embodiment, when images are formed on both sides of paper P, an image for a first side as a rear side of the paper ("first-side image") formed in the image forming unit is transferred from the photoreceptive drum 51 to the second intermediate transfer belt 70 through the first intermediate transfer belt 60. The image is carried on the transfer belt 70 and is made to travel round. During the travel, the image forming unit forms an image for a second side as a top surface of the paper ("second-side image"), and the image is transferred to the first intermediate transfer belt 60. It is needless to say that a timing is controlled to form the images on the paper P so as to position the first-side image and the second-side image on right places of the paper P.

The second-side image is transferred from the transfer belt 60 to one side (a right-side face of the paper conveyed from the lower side to the upper side in FIG. 6) of the paper P sent by the registration roller pair 82. The second-side image is transferred by the action of the transfer roller 75 disposed inside the loop of the second intermediate transfer belt 70. Further, the first-side image carried on the transfer belt 70 and having traveled round is transferred to the other side (a left-side face of the paper conveyed from the lower side to the upper side in FIG. 6) of the paper P. The first-side image is transferred by the action of the transfer rollers 74 and 75 disposed in the loop of the second intermediate transfer belt 70. Further, the transfer charger 77 forms an electric field so that the toner image on the transfer belt 70 is transferred to the paper by the electrostatic force, and the toner image is surely transferred to the paper. The images are transferred to both side of the paper P in the above manner, and the paper P is sent to the fixing device 90, and the front edge of the paper P is brought into contact with the pressurizing belt as explained by referring to FIG. 5, and the paper P together with the pressurizing belt is conveyed to the fixing roller. The fixing roller and the pushing roller pressurize and heat the paper P to fix the toner images on the paper P.

In such a structure, the paper P carrying the color toner images on both sides thereof can be smoothly transferred to the fixing device 90, and therefore, it is possible to obtain high-quality images and excellent conveying capability.

As explained above, according to the second embodiment and the third embodiment of the present invention, the recording medium can be smoothly transferred to the fixing device, thus achieving high-quality images and excellent conveying capability.

The present document incorporates by reference the entire contents of Japanese priority documents, 2002-273811 filed in Japan on Sep. 19, 2002 and 2002-274428 filed in Japan on Sep. 20, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

a first image carrier that transfers an image to a first surface of a recording medium;

a second image carrier that transfers an image to a second surface of the recording medium; and a conveying unit that directly conveys the recording medium, to which the image has been transferred by the second image carrier, substantially vertically from the second image carrier to a fixing unit, wherein a conveying speed of the recording medium at the fixing unit is equal to or lower than a conveying speed of the recording medium on the second image carrier.

2. The image forming apparatus according to claim 1, wherein the conveying speed of the recording medium at the fixing unit is 90 to 100% of the conveying speed of the recording medium on the second image carrier.

3. The image forming apparatus according to claim 1, wherein the second image carrier is made of heat-resistant material.

4. The image forming apparatus according to claim 3, wherein the heat-resistant material is polyimide.

5. The image forming apparatus according to claim 1, further comprising a cooling unit that cools the second image carrier.

6. The image forming apparatus according to claim 5, wherein the cooling unit includes a heat pipe.

7. The image forming apparatus according to claim 1, further comprising a cleaning unit that cleans toner remaining on the second image carrier while the toner melts due to heat from the fixing unit.

8. The image forming apparatus according to claim 7, wherein the cleaning unit includes a roller having a surface roughness greater than a surface roughness of the second image carrier, wherein the roller is moveably supported so as to touch the second image carrier or separate from the second image carrier.

9. The image forming apparatus according to claim 8, wherein the surface roughness of the second image carrier is 3.5 micrometers or less and the surface roughness of the roller is 3.5 micrometers or more.

10. The image forming apparatus according to claim 7, wherein the cleaning unit is moveable in such a manner that the cleaning unit touches the second image carrier or separates from the second image carrier, and wherein when there is an image on the second image carrier, the the cleaning unit separates from the second image carrier.

11. The image forming apparatus according to claim 1, wherein the first image carrier is an electrophotographic photoreceptor, and the second image carrier is a belt made of a material having a surface resistivity of a range from $10^5$ to $10^{12}$ Ω/sq.

12. The image forming apparatus according to claim 1, wherein a toner releasing layer is formed on the second image carrier.

13. The image forming apparatus according to claim 1, wherein the toner releasing layer is a layer of perfluoroalkoxy.

14. The image forming apparatus according to claim 1, wherein there is a gap between a position at which a recording medium on the second image carrier is transferred to the fixing unit and a position at which the recording medium is received in the fixing unit, and a width of the gap is 60 millimeters or less.

15. An image forming apparatus, comprising:

a first image carrier having a surface for carrying a toner image formed through an electrophotographic process;

a second image carrier on which the toner image on the first image carrier is transferred, and that conveys a recording medium;

a first transfer unit that transfers the toner image from the first image carrier to the second image carrier and to a first surface of the recording medium conveyed by the second image carrier;

a second transfer unit that transfers the toner image from the second image carrier to a second surface of the recording medium conveyed by the second image carrier;

a fixing unit disposed on downstream side of the second transfer unit with respect to direction of conveyance of the recording medium, the fixing unit including a fixing roller having a heat source;

a pushing roller that pushes the fixing roller; and a support roller, wherein a belt is wound around between the support roller and the pushing roller, and the support roller rotates in the same direction as that of the pushing roller to rotate the belt, wherein the fixing unit fixes the toner image on the recording medium; and a guide unit that conveys the recording medium from the second image carrier toward the fixing unit, that brings the recording medium into contact with the belt wherein an angle is set to 60 degrees or less, the angle being formed between a direction of conveying the recording medium by the second image carrier and a moving direction of a portion of the belt in a zone from the support roller toward the pushing roller, and that guides the recording medium to a nip part between the fixing roller and the pushing roller.

16. The image forming apparatus according to claim 15, wherein the angle is 30 degrees.

17. The image forming apparatus according to claim 15, wherein the guide unit is controlled so that a conveying speed of the recording medium by the second image carrier is set to be equal to a conveying speed of the belt, or a conveying speed of the recording medium is set to be faster than that of the belt.

18. The image forming apparatus according to claim 15, further comprising a unit that produces a potential difference between the belt and paper so that the paper adheres to the belt by electrostatic force.

19. The image forming apparatus according to claim 18, further comprising a charger that electrically charges the belt.

20. The image forming apparatus according to claim 19, wherein the charger applies an electric charge of a reverse polarity, with respect to a polarity of toner, to the belt.

21. An image forming system, comprising:

an image forming apparatus including a first image carrier that transfers an image to a first surface of a recording medium;

a second image carrier that transfers an image to a second surface of the recording medium; and a conveying unit that conveys the recording medium, to which the image has been transferred by the second image carrier, substantially vertically from the second image carrier to a fixing unit, wherein a conveying speed of the recording medium at the fixing unit is equal to or lower than a conveying speed of the recording medium on the second image carrier;

an information processing unit connected to the image forming apparatus through a communication means; and an image formation controlling unit that performs controls over image formation including transmission of data for image formation from the information processing unit to the image forming apparatus.

* * * * *